US006796229B2

(12) United States Patent
Görbing et al.

(10) Patent No.: US 6,796,229 B2
(45) Date of Patent: Sep. 28, 2004

(54) GEAR TRAIN FOR A MACHINE FOR PROCESSING FLAT PRINTING MATERIALS

(75) Inventors: Christian Görbing, Heidelberg (DE); Ivo Richter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/191,871

(22) Filed: Jul. 9, 2002

(65) Prior Publication Data

US 2003/0005835 A1 Jan. 9, 2003

(30) Foreign Application Priority Data

Jul. 9, 2001 (DE) ..... 101 33 271

(51) Int. Cl.[7] ..... B41F 5/00; B41F 7/02

(52) U.S. Cl. ..... 101/216; 101/171; 101/217; 101/218; 101/219; 101/492

(58) Field of Search ..... 101/216, 492, 101/171, 217, 218, 219; 74/405, 322, 333, 342

(56) References Cited

U.S. PATENT DOCUMENTS 3,979,965 A * 9/1976 Vuceta ..... 81/57
4,520,728 A * 6/1985 Ecker et al. ..... 101/248
4,696,229 A * 9/1987 Bezler et al. ..... 101/177
5,067,456 A * 11/1991 Beachley et al. ..... 123/197
5,458,013 A * 10/1995 Iwamoto ..... 74/322
5,653,143 A * 8/1997 Langevin ..... 74/348
5,979,317 A * 11/1999 Singler ..... 101/218
5,983,794 A * 11/1999 Emery ..... 101/217
6,109,176 A * 8/2000 Fujio et al. ..... 101/216
6,186,065 B1 * 2/2001 Kersch et al. ..... 101/216

FOREIGN PATENT DOCUMENTS

DE 135 812 10/1979
DE 43 25 033 C2 2/1995
DE 44 47 862 C2 4/1996
DE 100 56 850 A1 6/2001

* cited by examiner

*Primary Examiner*—Andrew H. Hirshfeld
*Assistant Examiner*—Marvin P Crenshaw
(74) *Attorney, Agent, or Firm*—Laurence A. Greenberg; Werner H. Stemer; Ralph E. Locher

(57) ABSTRACT

A gear train for a machine for processing flat printing materials includes a coupling for separating and closing the gear train. The gear train further includes rotating elements having toothing systems which, in a closed state of the gear train, are in mutual engagement and, in a separated state of the gear train, are out of engagement. A multiplicity of the rotating elements are combined into pairs. The toothing systems of one of the pairs of rotating elements has a tooth pitch differing from the toothing systems of a respective other of the pairs of rotating elements. A machine, including the gear train, for processing flat printing materials, is also provided.

7 Claims, 3 Drawing Sheets

GEAR TRAIN FOR A MACHINE FOR PROCESSING FLAT PRINTING MATERIALS

BACKGROUND OF THE INVENTION

Field of the Invention

The invention relates to a gear train for a machine for processing flat printing material, in particular a rotary printing machine, having a coupling for separating and closing the gear train, the coupling comprising rotating elements having toothing systems which, in the closed condition of the gear train, are in mutual engagement and, in the separated condition, are out of engagement, and also to a machine for processing flat printing materials, in particular a sheet-processing rotary printing machine, which is equipped with the gear train.

A gear train of the type mentioned at the introduction hereto is disclosed in German Patent DE 44 47 862 C2. The coupling disclosed therein serves for recoupling, with a changed phase angle, a part of the gear train that has been uncoupled by having been separated. Although, when compared with comparable frictional couplings, the formlocking coupling provided for this purpose increases the functional reliability of a rotationally fixed connection between two gears in the coupled condition, it is only possible to adjust to rotational angles corresponding to a multiple of the pitch of the toothing systems at the end faces of the coupling parts, i.e., the rotational angle of one of the two gears with respect to the other is variable only in steps corresponding to the pitch of the toothing systems. For reasons of strength and production, however, the amount of pitch is subject to a lower limit which, assuming a constructionally yet tolerable extent of the diameter of the coupling, cannot be sufficiently small for the positionally-correct adjustment of the aforementioned rotational angle. In the foregoing regard, it is noted that a formlocking coupling is a coupling by which a formlocking connection is made wherein two elements are connected together due to the shape of the elements, as opposed to a forcelocking connection wherein the elements are locked together by force external to the elements.

SUMMARY OF THE INVENTION

It is accordingly an object of the invention to provide a gear train for a machine for processing flat printing material so that, with a yet tolerable extent of the diameter of the coupling, a fine angular resolution relative to the mutual rotation of the gears is possible, and so that torque transmissible by the coupling has an adequate magnitude.

With the foregoing and other objects in view, there is provided in accordance with one aspect of the invention, a gear train for a machine for processing flat printing materials, comprising a coupling formed for separating and closing the gear train, the gear train further comprising rotating elements having toothing systems which, in a closed state of the gear train, are in mutual engagement and, in a separated state of the gear train, are out of engagement, a multiplicity of the rotating elements being provided combined into pairs, the toothing systems of one of the pairs of rotating elements having a tooth pitch differing from the toothing systems of a respective other of the pairs of rotating elements.

In accordance with another feature of the invention, the toothing systems of the rotating elements comprise Hirth-type toothing systems.

In accordance with a further feature of the invention, the toothing systems of the rotating elements comprise spur-gear toothing systems.

In accordance with an added feature of the invention, a first and a second of the pairs of rotating elements comprise one of the rotating elements common to both of the pairs.

In accordance with an additional feature of the invention, the toothing systems of the first and of the second pair of rotating elements are constructed as Hirth-type toothing systems.

In accordance with yet another feature of the invention, the rotating element common to the first and the second pair of rotating elements has a Hirth-type toothing system and a spur-gear toothing system, and a correspondingly toothed one of the rotating elements, respectively, is assigned to the common rotating element.

In accordance with yet a further feature of the invention, respectively, an end one of the rotating elements forming the coupling constitutes a gear of the gear train.

In accordance with yet an added feature of the invention, the rotating element common to the first and the second pair of rotating elements has a jacket surface forming a toothing system, the gear train further comprising a setting pinion meshing with the toothing system, the common rotating element being rotatable by the setting pinion when the gear train is separated.

In accordance with another aspect of the invention, there is provided a machine for processing flat printing materials, including a gear train, comprising a coupling formed for separating and closing the gear train, the gear train further comprising rotating elements having toothing systems which, in a closed state of the gear train, are in mutual engagement and, in a separated state of the gear train, are out of engagement, a multiplicity of the rotating elements being provided combined into pairs, the toothing systems of one of the pairs of rotating elements having a tooth pitch differing from the toothing systems of a respective other of the pairs of rotating elements.

In accordance with a concomitant feature of the invention, the machine of the invention is a sheet-processing rotary printing machine.

The object of the invention is achieved by utilizing the features of the multiplicity of rotating elements being provided combined into pairs, and the toothing systems of one of the pairs of rotating elements having a tooth pitch that differs from that of the toothing systems of a respective other of the pairs of rotating elements.

By a realization of the invention, the aforementioned angular resolution can be made many times finer than that of heretofore known couplings, in fact, especially not at the expense of the strength of the toothing systems of the rotating elements forming the coupling. This is because the minimum step width for changing the mutual phase angle of two gear-train sections in the case of a construction of a gear train according to the invention is not limited downwardly by the pitch of the toothing systems of a pair of the rotating elements but, in the case of two pairs of rotating elements, is limited by the pitch difference between the toothing systems thereof, so that heavily loadable toothing systems can be provided. When the toothing systems are constructed in the form of Hirth-type toothing systems, there results, furthermore, the advantages of automatic centering of the rotating elements and freedom from play.

Other features which are considered as characteristic for the invention are set forth in the appended claims.

Although the invention is illustrated and described herein as embodied in a gear train for a machine for processing flat printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
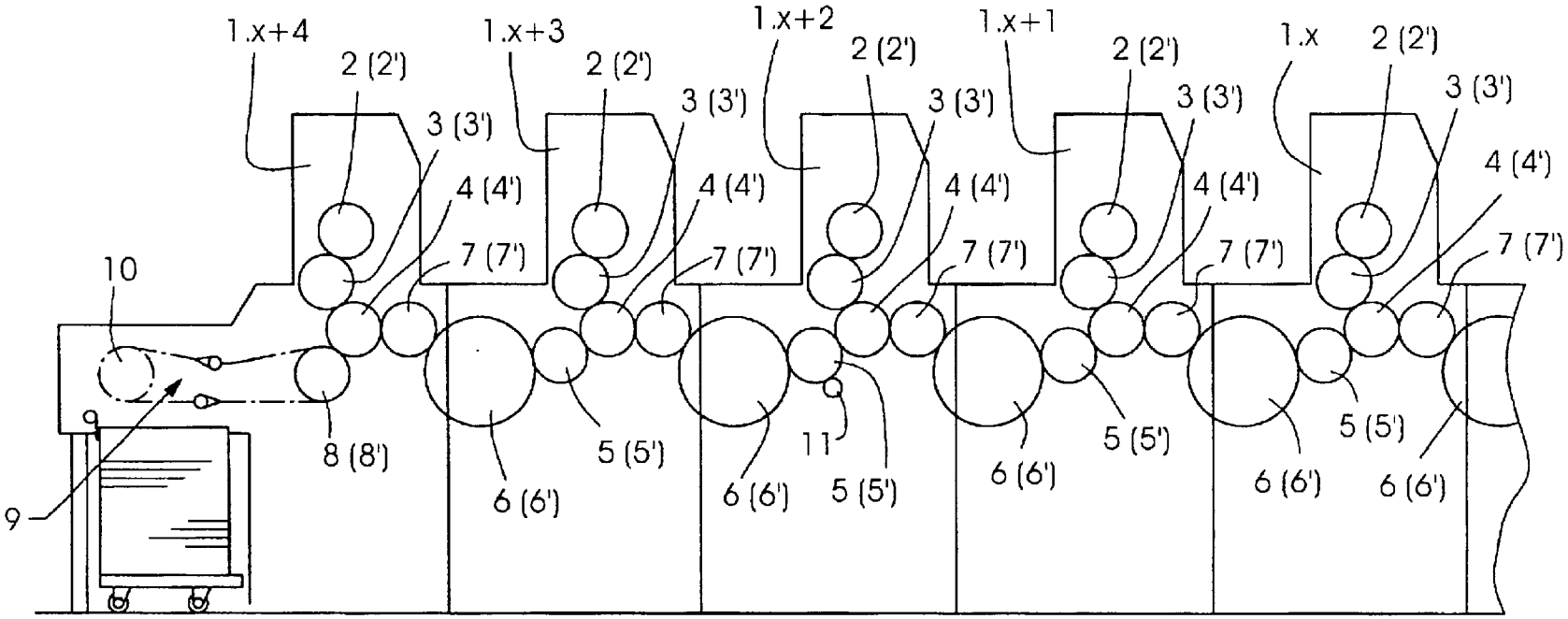
FIG. 1 is a fragmentary diagrammatic side elevational view of a sheet-processing rotary printing machine having in-line arranged processing stations, shown here, for example, exclusively as printing units driven by a gear train.

Referring now to the drawings and, first, particularly to FIG. 1 thereof, there is shown therein, in a diagrammatic side elevational view, printing units 1.*x*, 1.*x*+1 to 1.*x*+4 aligned in a row and representing, by way of example, a sheet-processing rotary printing machine operating in accordance with the offset process principle, and effecting a transfer of sheets by drums provided with gripper systems, from respectively preceding ones of the printing units to respectively following ones of the printing units. Accordingly, a respective one of the printing units 1.*x* and 1.*x*+1 to 1.*x*+4 comprises an inking unit not illustrated in FIG. 1, a non-illustrated dampening unit when operating in accordance with the wet offset process principle, printing unit cylinders in the form of a plate cylinder 2, a blanket cylinder 3 and an impression cylinder 4 and, between a preceding one of the printing units 1.*x* and 1.*x*+1 to 1.*x*+4 and a following one thereof, respectively, there is arranged a first transfer drum 5 that picks up sheets from the impression cylinder 4 of the preceding printing unit, a storage drum 6 that picks up the sheets from the first-transfer drum 5, and a second transfer drum 7 that picks up the sheets from the storage drum 6 and transfers the respective sheet to the impression cylinder 4 of the following printing unit. In this regard, preferably at least one sheet transfer device formed by a first and a second one of the transfer drums 5 and 7 and one of the storage drums 6 is configured as a reversing or turning device that is convertible from a first into a second operating state and from the second into the first operating state in such a way that, in a first operating mode, the second transfer drum 7 transfers a respective sheet with the leading edge thereof leading or in front and, in the second operating mode, with the trailing edge of the sheet leading or in front and reversed or turned to the following impression cylinder 4.

It is believed to be apparent that the sheet-guiding drums and cylinders comprise gripper systems provided for picking up, guiding and transferring the sheets.

The impression cylinder 4 of the last printing unit, i.e., the printing unit 1.*x*+4 in the example at hand, is followed by a delivery drum 8 which, in operation, drives a revolving gripper system 9 guiding the sheets which, during operation are transferred from a feeding drum, not illustrated—in FIG. 1, to the impression cylinder of a first printing unit, and out of the rotary printing machine.

In order to load the feeding drum with the sheets, an oscillating pregripper device not illustrated in FIG. 1 is also provided for picking up from the feeding table sheets drawn off individually from a feed pile by a separating or singling device and aligned on front and side lays of a here non-illustrated feeding table by an alignment device, and for transferring the picked-up sheets to the feeding drum.

In order to drive the printing-unit cylinders, the drums, the sheet transfer devices, that part of the inking and dampening unit rollers which is not driven via friction, the delivery drum, the feeding drum, the pregripper device, the alignment device and the separating or singling device, a coherent or interconnected gear mechanism is provided in the example at hand and mainly is represented by intermeshing gears, while chain drives are provided only for driving deflecting wheels 10 belonging to the gripper system 9 on the side of the delivery drum 8, and the separating or singling device on the side of the feeding drum.

The intermeshing gears, to the extent they are reproduced in FIG. 1, are constituted of a respective gear 2' associated with a respective one of the plate cylinders 2, a respective gear 3' associated with a respective one of the blanket cylinders 3, a respective gear 4' associated with a respective one of the impression cylinders 4, a respective gear 5' associated with a respective one of the first transfer drums 5, a respective gear 6' associated with a respective one of the storage drums 6, a respective gear 7' associated with a respective one of the second transfer drums 7, and as a gear 8' associated with the delivery drum 8.

It is believed to be readily apparent that, between a respective one of the cylinders and a respective one of the drums, on the one hand, and the gears 2' to 8' associated therewith, as explained hereinbefore, on the other hand, a rotationally fixed connection. In the diagrammatic view of FIG. 1, a respective one of the gears 2' to 8' is illustrated in the same way as the respective cylinder or the respective drum associated therewith.

Considering all of the aforementioned gears 2' to 8' in their entirety, a coherent or interconnected gear train is formed thereby with a main strand which, in the illustrated example according to FIG. 1, extends from the printing unit 1.*x*+4, constructed as the delivery printing unit, over all the preceding printing units, and with side strands, which branch off from the respective gear 4' driving one of the impression cylinders 4, and drive respective printing unit cylinders in the form of a respective one of the blanket cylinders 3 and a respective one of the plate cylinders 2, and also here non-illustrated inking unit rollers and possibly dampening unit rollers. For this reason, the printing unit 1.*x*+4 is designated as the delivery printing unit here, because this is followed by a gripper system 9 that serves to deliver the printed sheets and is driven by the gear 8' belonging to the delivery drum 8 and meshing with the gear 4' of the impression cylinder 4 of the printing unit 1.*x*+4.

In the example shown in FIG. 1, the printing unit 1.*x*+2 forms a so-called drive printing unit, i.e., the feed of the driving power for operating the rotary printing machine is provided via a gear associated with the printing unit 1.*x*+2, here via that gear 5' which drives one of the first transfer drums 5 and which meshes, in particular, with that gear 4' that is associated with the impression cylinder 4 of the printing unit 1.*x*+2 and with that gear 6' which is assigned to that storage drum 6 following the printing unit 1.*x*+2 in the direction towards the printing unit 1.*x*+3, and meshes with a drive pinion 11 which is driven via a non-illustrated drive, preferably a belt drive.

In the afore-indicated configuration of one of the sheet transfer devices which is formed from a first transfer drum 5, a second transfer drum 7 and a storage drum 6 arranged therebetween, as a reversing or turning device, for example, the second transfer drum 7 is constructed as a reversing or turning drum, in that the gripper system thereof, in the case of recto or first-form printing, picks up a sheet guided by the storage drum 6 at the leading edge of the sheet, and transfers it to the impression cylinder 4 following the reversing or turning drum, while the same gripper system, in the perfector printing stage, picks up the sheet at the trailing edge thereof from the storage drum 6. The phase angle of the reversing or turning drum 7 in relation to the storage drum 6, which is different, respectively, for this purpose, is set by undoing or dividing the gear train comprising the aforementioned main strand, rotating or untwisting one partial strand produced in the process with respect to another, and finally closing the gear train. It is believed to be readily apparent that a corresponding gripper system guiding a respective sheet and belonging to the storage drum 6 releases the sheet with a delay and a phase shift in first-form and perfecting or recto-verso operation as compared with only a one-side or recto printing operation in order for the sheet trailing edge to be picked up by the reversing or turning drum 5, the measurement in radians or arc measurement of the phase shift corresponding at least approximately to the extent of the sheet format in the peripheral direction of the storage drum 6. For this purpose, a conventional adjustable device is provided for opening the aforementioned gripper system.

Figure 2:
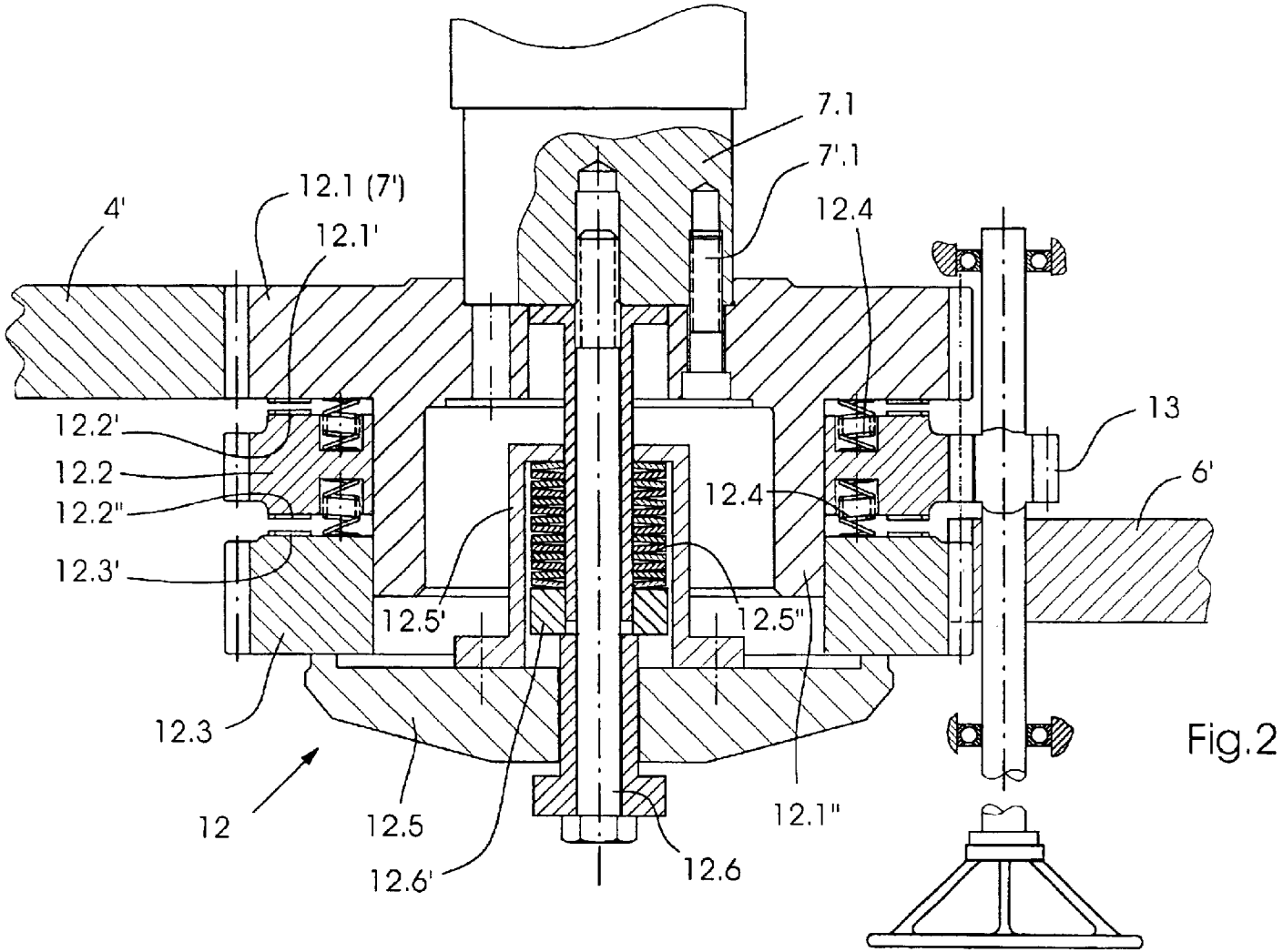
FIGS. 2 and 3 are enlarged fragmentary cross-sectional views of FIG. 1 showing different exemplary embodiments of a coupling used in the gear train.

FIG. 2 reproduces part of the gear train shown in FIG. 1, which is formed of the gears 4', 7' and 6', and more specifically, by way of example, that part of the gear train wherein the gear 4' is associated with the impression cylinder 4 of the printing unit 1.$x$+1. In this case, this printing unit is preferably preceded by four printing units, so that the sheets can be printed in four colors on both sides in a first-form and perfector or recto/verso printing operation.

If a corresponding print job follows a machine setting for recto or perfector printing, the aforementioned adjustment of the phase angle of the gripper system of the reversing or turning drum 7 of the printing unit 1.$x$+1 in relation to that of the gripper system of the upstream storage drum 6 is performed, particularly.

The part of the gear train illustrated in FIG. 2 comprises a coupling 12 which is provided for this purpose and, in the released state of which, the gear train is separated, and the aforementioned adjustment of the phase angle can be performed by appropriate rotation of one of the aforementioned partial strands with respect to the other.

The coupling 12, reproduced here in the released state, comprises a multiplicity of rotating elements which are arranged entirely coaxially here, including in the exemplary embodiment of FIG. 2 three rotating elements 12.1, 12.2 and 12.3, which are combined functionally into pairs. A first pair is formed by the rotating elements 12.1 and 12.2, and a second pair is formed by the rotating elements 12.2 and 12.3. The rotating element 12.2 is common to both pairs.

At mutually facing ends of the rotating elements, toothing systems 12.1', 12.2', 12.2" and 12.3' are provided, which are constructed here in the form of Hirth-type serrations.

The two rotating elements 12.1 and 12.3 at the ends, respectively, form a gear of the gear train inasmuch as they are constructed to engage respectively with a gear thereof, so that the rotating element 12.1 meshes with the gear 4' of the impression cylinder 4, and the rotating element 12.3 meshes with the gear 6' of the storage drum 6. The rotating element 12.1, in this regard, moreover constitutes the gear 7' rotationally fixedly associated with the reversing or turning drum 7 and, to this end, is fixed to an axle journal 7.1 of the reversing or turning drum 7 by a screw connection 7'.1. Formed on the rotating element 12.1 that forms the gear 7' is an attachment 12.1" which faces away from the axle journal 7.1 and whereon, in succession, the rotating element 12.2 and the rotating element 12.3 are pushed, it being possible for these to be rotated with respect to the rotating element 12.1 in the released state of the coupling 12. Between respective mutually facing ends of the rotating elements 12.1, 12.2 and 12.3 there are arranged, respectively, compression springs 12.4 which are supported thereon and which ensure that the toothing systems 12.1' and 12.2' and the toothing systems 12.2" and 12.3' are disengaged in the released state of the coupling 12.

A pressure disk 12.5, which is set against an end of the rotating element 12.3 facing away from the axle journal 7.1, serves for closing the coupling 12.5. On the side thereof facing towards the axle journal 7.1, the pressure disk 12.5 bears a spring housing 12.5', wherein a disk spring pack 12.5" is arranged, here coaxially with respect to the axle journal 7.1. In order to apply tension to the disk spring pack 12.5" and therefore to close the coupling 12, as well as to close the gear train that accompanies it, a tensioning screw 12.6 is inserted into the axle journal 7.1 at the end and centrally thereof, passing through the pressure disk 12.5, the disk spring pack 12.5", the spring housing 12.5' and a compression ring 12.6' that is set against the disk spring pack 12.5" and is actuatable by the tensioning screw 12.6. By screwing the tensioning screw 12.6 into the axle journal 7.1, starting from the released state of the coupling 12 illustrated in rig. 2, the disk spring pack 12.5" displaces the pressure disk 12.5 in the direction of the axle journal 7.1 and, initially, brings the toothing systems 12.1' and 12.2' of a first pair of the rotating elements 12.1, 12.2, 12.3 and the toothing systems 12.2" and 12.3' of a second pair thereof into mutual engagement counter to the restoring action of the compression springs 12.4 and, after these toothing systems have been secured with a formlocking connection, effects an axial bracing of the rotating elements 12.1, 12.2 and 12.3.

The toothing systems 12.1' and 12.2' of the pair of rotating elements formed by the rotating elements 12.1 and 12.2 have a pitch which differs from that of the toothing systems 12.2" and 12.3' of the pair of rotating elements formed by the rotating elements 12.2 and 12.3. The toothing systems 12.1', 12.2', 12.2" and 12.3' are, in this regard, constructed as a whole as Hirth-type toothing systems in this embodiment.

As a consequence of the following exemplary embodiment, based upon the aforementioned pitch difference, the step width of a mutual rotation of the end rotating elements 12.1 and 12.3 can be reduced by the multiple of a power of ten with respect to a coupling known heretofore from the prior art and having a single separation location.

If it is assumed, for example, that the aforementioned single separation location were formed by a pair of rotating elements having toothing systems which, when coupled, respectively have thirty-six teeth, then the result of the smallest step width would be a rotational angle of 10 degrees. If the number of teeth in the case of the coupling 12 is provided, for example, for the toothing systems 12.1' and 12.2' of the pair of rotating elements 12.1 and 12.2 and a tooth count of thirty-seven, for example, is provided for the toothing systems 12.2" and 12.3' of the pair of rotating elements 12.2 and 12.3, then by self-rotation or together with the rotating elements 12.2 by one tooth pitch of the toothing systems 12.1' and 12.2' in a first direction of rotation and subsequent rotation by the tooth pitch corresponding to the tooth count of thirty-seven teeth in a direction opposite to the first direction of rotation, the rotating element 12.3 can be rotated with respect to the rotating element 12.1, and the coupling 12 can be closed in this rotational position of the rotating element 12.3. This results overall in a rotation of the rotating element 12.3 with respect to the rotating element 12.1 by less than 20 minutes of arc and corresponds to a step width which is smaller by more than thirty times than in the case of the assumed single separation location.

An adjustment of the mutual phase angle of the reversing or turning drum 2 and of the storage drum 6 over specific rotational angles, which is realizable with the coupling 12, is represented, in particular, in that the coupling 12 is released, at least one of the partial strands of the gear train produced thereby is rotated to a predetermined extent, the rotating element 12.2 is brought into a rotational position wherein, when the coupling 12 is subsequently closed, a minimum of mutual rotation of the end rotating elements 12.1 and 12.3 occurs, and finally the coupling 12 is closed.

In order to bring the rotating element 12.2 that is common to the first pair of rotating elements 12.1 and 12.2 and the second pair of rotating elements 12.2 and 12.3 into the aforementioned rotational position, a toothing system is constructed on the jacket surface thereof and an adjusting pinion 13 shown offset in FIG. 2, which meshes with this toothing system, is adjustable manually here, for example.

Figure 3:
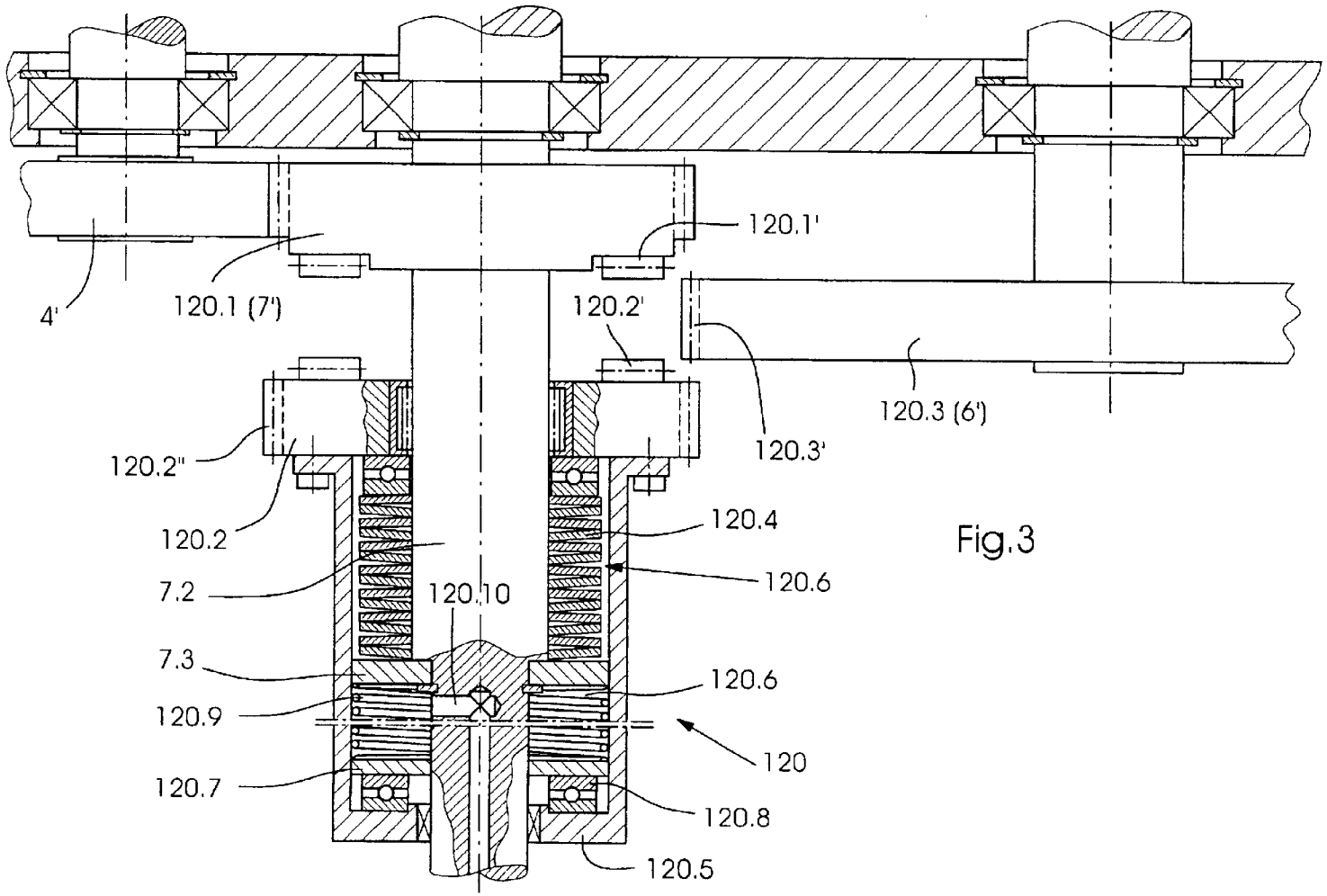

The configuration illustrated in FIG. 3 of a corresponding coupling 120, in turn, comprises, in functional terms, rotating elements 120.1, 120.2 and 120.3 which are combined into two pairs of rotating elements, which are provided with toothing systems 120.1', 120.2' and 120.2", 120.3 constructed for mutual engagement in the closed state of the gear train that is again illustrated only as a detail here, and to this extent reproduces only the gears 4' and 6' and the gear 7' represented by the end rotating element 120.1, in such a way that the toothing systems 120.1' and 120.2' of the first pair of rotating elements formed by the rotating elements 120.1 and 120.2 have a tooth pitch which differs from that of the second pair of rotating elements formed by the rotating elements 120.2 and 120.3. To this extent, the coupling 120 has the same principle of action as the aforedescribed coupling 12 and, in fact, one of the rotating elements, specifically the rotating element 120.2, is common to both pairs of rotating elements. The rotating element 120.2, however, and the rotating element 120.3 differ from the exemplary embodiment according to FIG. 2 in that the toothing systems provided for the mutual engagement in the closed state of the gear train are not exclusively formed by Hirth-type toothing systems. Although appropriate Hirth-type toothing systems are provided in the form of the toothing systems 120.1' and 120.2' for the mutual engagement of the first pair of rotating elements, the second pair of rotating elements have toothing systems in the form of spur gear toothing systems 120.2" and 120.3' for mutual engagement in the closed state of the gear train.

In addition to the end rotating element 120.1 already mentioned hereinbefore and forming the gear 7' of the reversing or turning drum 7, the coupling 120 also comprises a second rotating element, here in the form of the rotating element 120.3, which forms a gear in the gear train and which is illustrated in FIG. 3 as the gear 6' of the storage drum 6.

According to the constructional refinement or exemplary embodiment reproduced by way of example in FIG. 3, the rotating element 120.2 common to the pairs of rotating elements is rotatably and axially displaceably mounted on an axle journal 7.2 that guides the rotating element 120.1, specifically on a part of the journal 7.2 which faces away from the reversing or turning drum 7 and projects beyond the rotating element 120.1. Supported on a supporting ring 7.3 fixed to the axle journal 7.2, on one side, and to the rotating element 120.2, on the other side, is a disk spring pack 120.4 which, while prestressing the disk spring pack 120.4, keeps the toothing systems 120.1', 120.2' in mutual engagement with the toothing systems 120.2", 120.3' and, in the opened state of the coupling 120 reproduced in FIG. 3, is under additional tension.

This additional tension for opening the coupling 120 is applied pneumatically, for example. For this purpose, on the end of the rotating element 120.2 facing away from the toothing system 120.2', a cylinder 120.5 that is opened toward this end is flange-mounted, forming a pressure chamber 120.6 specifically between the supporting ring 7.3, which is sealed off appropriately for this purpose, and a further appropriately sealed supporting ring 120.7, which is supported via a thrust bearing 120.8 on the end wall of the cylinder 120.5 which encloses the axle journal 7.2 and faces away from the Hirth-type toothing system 120.2'. A compression spring 120.9 clamped between the two supporting rings 7.3 and 120.7 keeps the supporting ring 120.7 in contact with the thrust bearing 120.8.

In the released state of the coupling 120 illustrated in FIG. 3, i.e., when the gear train is separated, the pressure chamber 120.6 is subjected to a pressure by the action of which the cylinder 120.5 keeps the toothing systems 120.2' and 120.2" of the rotating element 120.2 connected to the cylinder disengaged under the tension of the disk spring pack 120.4 via the aforementioned prestressing of the latter.

A borehole 120.10 opening into the pressure chamber 120.6 indicates the connection of the pressure chamber 120.6 to a compressed-air producer, for example. For this purpose, a rotary inlet, not otherwise specifically illustrated, is preferably provided on the axle journal 7.2.

The adjustment of the mutual phase angle of the partial strands produced by separating the gear train by the coupling 120 is carried out in the manner heretofore already explained in connection with FIG. 2. For this purpose, in a manner analogous to the improvement therein, the rotating element 120.2 has preferably assigned thereto a setting pinion that meshes with the spur gear toothing system 120.2" of the rotating element 120.2.

We claim:

1. A gear train for a machine for processing flat printing materials, comprising:

a drive belt and pinion for driving the gear train;

a coupling for separating and closing the gear train; and rotating elements having toothing systems in mutual engagement in a closed state of the gear train and out of engagement in a separated state of the gear train;

a multiplicity of said rotating elements being combined into pairs, and said toothing systems of one of said pairs of rotating elements having a tooth pitch differing from said toothing systems of a respective other of said pairs of rotating elements;

said toothing systems of said rotating elements being Hirth-type toothing systems.

2. A gear train for a machine for processing flat printing materials, comprising:

a coupling for separating and closing the gear train; and rotating elements having toothing systems in mutual engagement in a closed state of the gear train and out of engagement in a separated state of the gear train;

a multiplicity of said rotating elements being combined into pairs, and said toothing systems of one of said pairs of rotating elements having a tooth pitch differing from said toothing systems of a respective other of said pairs of rotating elements;

a first and a second of said pairs of rotating elements forming one of said rotating elements common to both of said pairs, said toothing systems of said first and of said second pair of rotating elements being constructed as Hirth-type toothing systems.

3. A gear train for a machine for processing flat printing materials, comprising:

a coupling for separating and closing the gear train; and rotating elements having toothing systems in mutual engagement in a closed state of the gear train and out of engagement in a separated state of the gear train;

a multiplicity of said rotating elements being combined into pairs, and said toothing systems of one of said pairs of rotating elements having a tooth pitch differing from said toothing systems of a respective other of said pairs of rotating elements;

a first and a second of said pairs of rotating elements forming one of said rotating elements common to both of said pairs, said rotating element common to said first and said second pair of rotating elements having a Hirth-type toothing system and a spur-gear toothing system, and a correspondingly toothed one of said rotating elements being assigned to said common rotating element.

4. The gear train according to claim 1, wherein an end one of said rotating elements of said coupling constitutes a gear of the gear train.

5. A gear train for a machine for processing flat printing materials, comprising:

a coupling for separating and closing the gear train; and rotating elements having toothing systems in mutual engagement in a closed state of the gear train and out of engagement in a separated state of the gear train;

a multiplicity of said rotating elements being combined into pairs, and said toothing systems of one of said pairs of rotating elements having a tooth pitch differing from said toothing systems of a respective other of said pairs of rotating elements;

a first and a second of said pairs of rotating elements forming one of said rotating elements common to both of said pairs, said rotating element common to said first and said second pair of rotating elements having a jacket surface forming a toothing system, a setting pinion meshing with said toothing system, and said common rotating element being rotatable by said setting pinion when the gear train is separated.

6. A machine for processing flat printing materials, comprising:

a revolving gripping system for guiding the sheets;

a coupling; and a gear train to be separated and closed by said coupling, said gear train including rotating elements having toothing systems in mutual engagement in a closed state of the gear train and out of engagement in a separated state of the gear train;

a multiplicity of said rotating elements being combined into pairs, and said toothing systems of one of said pairs of rotating elements having a tooth pitch differing from said toothing systems of a respective other of said pairs of rotating elements;

said toothing systems of said rotating elements being Hirth-type toothing systems.

7. A sheet-processing rotary printing machine, comprising:

a rotary printing cylinder including a plate cylinder, a blanket cylinder and an impression cylinder;

a coupling; and a gear train to be separated and closed by said coupling, said gear train including rotating elements having toothing systems in mutual engagement in a closed state of the gear train and out of engagement in a separated state of the gear train;

a multiplicity of said rotating elements being combined into pairs, and said toothing systems of one of said pairs of rotating elements having a tooth pitch differing from said toothing systems of a respective other of said pairs of rotating elements;

said toothing systems of said rotating elements being Hirth-type toothing systems.

* * * * *